US009145151B2

(12) United States Patent
Dierkes et al.

(10) Patent No.: US 9,145,151 B2
(45) Date of Patent: Sep. 29, 2015

(54) METHOD FOR OPERATING A SWITCHING HUMP SYSTEM AND CONTROL MEANS FOR THE SAME

(75) Inventors: Gerhard Dierkes, Cremlingen (DE); Mario Huster, Evessen (DE); Martin Jung, Warberg (DE)

(73) Assignee: Siemens Aktiengesellschaft, Munich (DE)

( * ) Notice: Subject to any disclaimer, the term of this patent is extended or adjusted under 35 U.S.C. 154(b) by 54 days.

(21) Appl. No.: 14/234,009

(22) PCT Filed: Jul. 4, 2012

(86) PCT No.: PCT/EP2012/063009

§ 371 (c)(1),
(2), (4) Date: Jan. 21, 2014

(87) PCT Pub. No.: WO2013/010793

PCT Pub. Date: Jan. 24, 2013

(65) Prior Publication Data

US 2014/0137762 A1 May 22, 2014

(30) Foreign Application Priority Data

Jul. 18, 2011 (DE) ..... 10 2011 079 335

(51) Int. Cl.
*B61K 7/12* (2006.01)
*B61K 7/02* (2006.01)
(Continued)

(52) U.S. Cl.
CPC ... *B61K 7/02* (2013.01); *B61J 3/02* (2013.01); *B61K 7/12* (2013.01); *B61L 17/00* (2013.01); *B61L 25/021* (2013.01)

(58) Field of Classification Search
CPC ..... B61J 3/02; B61K 7/02; B61K 7/12; B61L 17/00; B61L 17/02; B61L 17/026; B61L 25/00; B61L 25/02; B61L 25/021
See application file for complete search history.

(56) References Cited

U.S. PATENT DOCUMENTS 3,217,159 A * 11/1965 Auer, Jr. et al. ..... 246/182 A
3,237,007 A * 2/1966 Crawford ..... 246/182 A
(Continued)

FOREIGN PATENT DOCUMENTS

DE 1166811 4/1964
DE 2654669 A1 6/1978
(Continued)

OTHER PUBLICATIONS

"Automatisierungssystem für Zugbildungsanlagen MSR32—Mehr Efficyieny and Sicherheit im Giiteryerkehr", Siemens AG, 2010.

*Primary Examiner* — Jerrah Edwards
*Assistant Examiner* — Tamara Weber
(74) *Attorney, Agent, or Firm* — Laurence A. Greenberg; Werner H. Stemer; Ralph E. Locher

(57) ABSTRACT

A method for operating a switching hump yard, wherein in a first operating mode a lower master retarder is controlled in such a manner that cuts in the form of descending cars or groups of cars reach a classification track retarder of a classification track at a speed that is lower than a first threshold, a switch is made from the first operating mode into a second operating mode if a target for a cut is found in or in front of the classification track retarder of the classification track, and in the second operating mode the master retarder is controlled in such a manner that the cut reaches the determined target in or in front of the classification track retarder at a speed that is lower than a second threshold. We also describe a controller for controlling such a switching hump yard.

15 Claims, 1 Drawing Sheet

(51) Int. Cl.

| | |
|---|---|
| ***B61J 3/02*** | (2006.01) |
| ***B61L 17/00*** | (2006.01) |
| ***B61L 25/02*** | (2006.01) |

(56) References Cited

U.S. PATENT DOCUMENTS

| | | | | |
|---|---|---|---|---|
| 3,251,991 | A | 5/1966 | Coley et al. | |
| 3,463,919 | A * | 8/1969 | Rold et al. | 246/182 BH |
| 3,654,456 | A * | 4/1972 | Sarbach | 246/182 BH |
| 5,758,848 | A * | 6/1998 | Beule | 246/182 B |
| 6,418,854 | B1 * | 7/2002 | Kraft | 104/26.1 |
| 2002/0082814 | A1 * | 6/2002 | Doner | 703/6 |
| 2008/0154449 | A1 * | 6/2008 | Borntraeger | 701/19 |
| 2009/0072096 | A1 * | 3/2009 | Ottow | 246/182 BH |

FOREIGN PATENT DOCUMENTS

| | | | |
|---|---|---|---|
| DE | 2852784 | A1 | 6/1980 |
| DE | 3005675 | A1 | 8/1981 |
| DE | 4305513 | A1 | 8/1994 |
| DE | 4305514 | A1 | 8/1994 |
| RU | 2034730 | C1 | 5/1995 |
| RU | 2008147992 | A | 6/2010 |

* cited by examiner

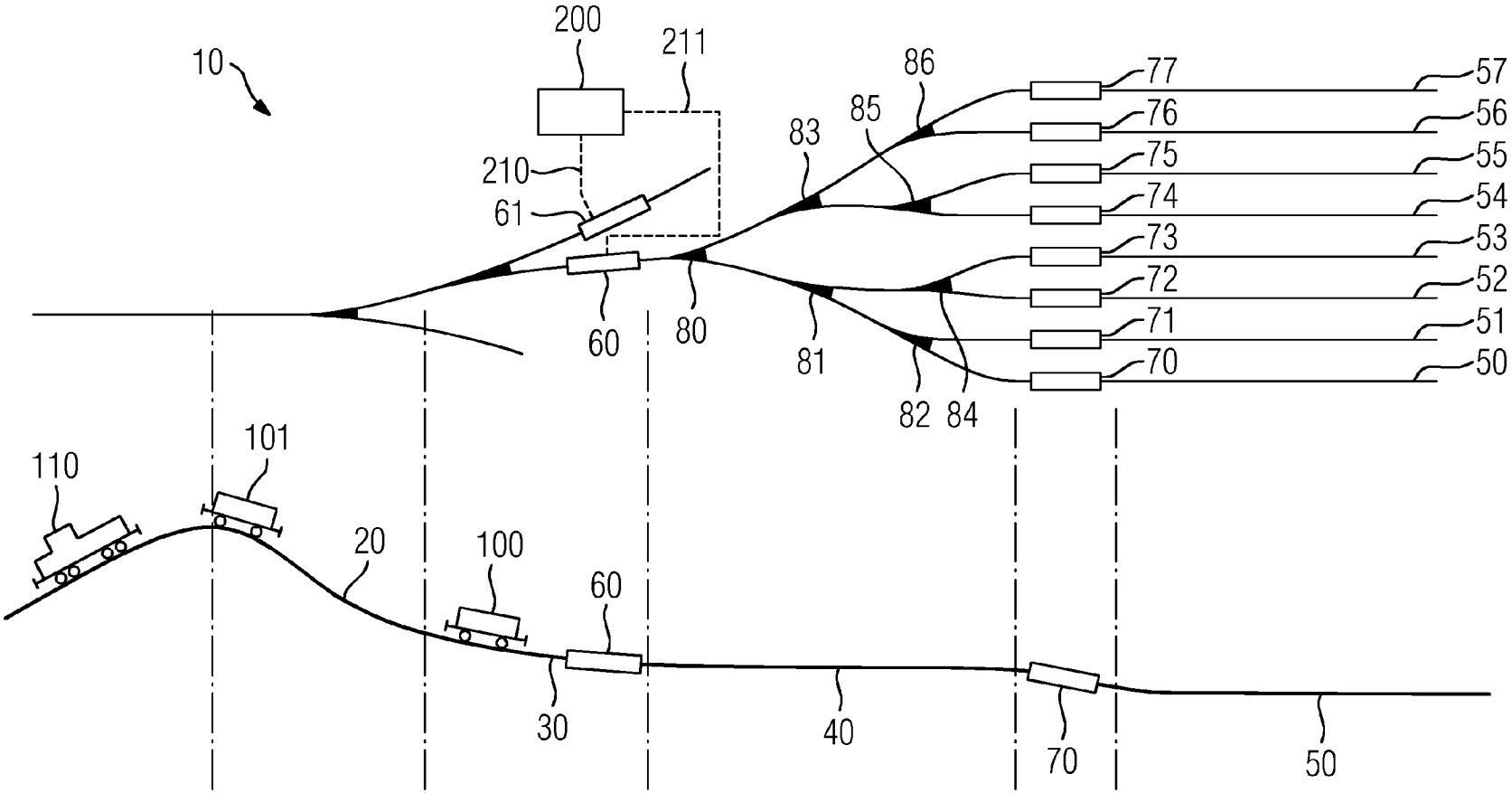
57
56
55
54
53
52
51
50
77
76
75
74
73
72
71
70
86
85
83
84
82
81
80
211
200
210
61
60
50
70
40
60
30
100
20
101
110
10

METHOD FOR OPERATING A SWITCHING HUMP SYSTEM AND CONTROL MEANS FOR THE SAME

BACKGROUND OF THE INVENTION

Field of the Invention

In switching hump yards, cars or car groups (also referred to as cuts) are sorted from a hump track into different classification tracks using the force of gravity that acts on the cuts. For reasons of efficiency and reliability, the operation of the hump yard is usually automated to a large extent in this type of configuration. A suitable automatic control system for this purpose is disclosed, for example, in the company publication "Automatisierungssystem für Zugbildungsanlagen MSR32—Mehr Effizienz and Sicherheit in the Güterverkehr", Order No. A19100-V100-B898-V1, Siemens AG, 2010. In this case, automatic speed adjustment of the cuts is achieved by controlling a lower main retarder accordingly, such that the entry speed of the cuts into the next braking stage, in the form of a classification track retarder, does not exceed a first threshold value. This ensures that adequate braking of the cuts can be achieved by the classification track retarder, this being disposed at the start of the respective classification track, under any circumstances normally occurring in practice.

BRIEF SUMMARY OF THE INVENTION

The object of the present invention is to specify a method for operating a switching hump yard, which method allows even greater automation of the operation of the hump yard and ultimately therefore an improvement in the performance of the hump yard.

This object is inventively achieved by a method for operating a switching hump yard, wherein in a first operating mode a lower main retarder is controlled such that cuts in the form of rolling cars or car groups reach a classification track retarder of a classification track at a speed which is lower than a first threshold value, a switch from the first operating mode to a second operating mode occurs if a target is identified in or ahead of the classification track retarder of the classification track, and in the second operating mode the lower main retarder is controlled such that the cut reaches the identified target in or ahead of the classification track retarder at a speed which is lower than a second threshold value.

According to the first step of the inventive method, in a first operating mode, a lower main retarder is therefore controlled such that the cuts reach the classification track retarder of the respective classification track at a speed which is lower than a first threshold value. Taking this first operating mode as a starting point, the second step of the inventive method now provides for switching to a second operating mode in the event that a target for a cut is identified in or ahead of the classification track retarder of the classification track. This means that it is already recognized before the cut actually reaches the lower main retarder that the cut will not pass through the classification track retarder as planned, or at least not fully. In relation to the cut concerned, the braking capacity of the classification track retarder is therefore not available, or at least not fully available, for the purpose of braking the cut.

Specifically, the above described instance occurs in practice when the relevant classification track is already filled with cars as far as the classification track retarder, wherein gaps may exist between the individual cars or car groups. In the event of a corresponding occupancy level of a classification track, conventional methods for the operation of hump yards can no longer guarantee the required shunting quality, i.e. in particular the prevention of an unacceptably high impact speed of the cuts relative to standing cars. In this situation, it is already possible in principle to advance further cuts destined for the classification track manually into the relevant region by means of free shunting of the complete train which is still standing at the hump. Alternatively, it is also possible for the handbrake of the relevant car to be activated manually by an operator and for the car to be allowed to run under manual braking in this way. However, both cases result in considerable delays and impediments to the humping operation. With regard to possible manual braking of the cars, it must also be taken into account that such an approach will often fail simply because the cars to be braked do not have a handbrake, particularly in the case of newer freight cars.

In order now to allow the automatic humping operation to continue even if the classification track is overfilled to the extent that the target of a cut lies in or even ahead of the classification track retarder of the classification track, the third step of the inventive method provides for the lower main retarder to be controlled such that, in the second operating mode, the cut reaches the identified target in or ahead of the classification track retarder at a speed which is lower than a second threshold value. This means that, in contrast with the first operating mode, the control of the lower main retarder in the second operating mode is effected such that braking relates to the respective target and not to the respective classification track retarder. Moreover, the control of the lower main retarder and/or the speed adjustment of the cut by the lower main retarder is effected here such that the cut reaches the identified target at a speed which is lower than the second threshold value. The second threshold value can typically be approximately 1.5 m/s here, since this is a normal target speed for the impact of a cut against a stationary car. By contrast, the first threshold value in the first operating mode is typically approximately 4 m/s, since this is a normal value for a permitted entry speed into a classification track retarder in practice.

According to the foregoing explanations, the inventive method is therefore already characterized in that automatic operation of the hump yard is also permitted in the event that the occupancy of a classification track extends into the respective classification track retarder or beyond. Not only is occupancy or use of this region actually permitted, but automatic operation of the hump yard is also possible as a result of the switch from the first operating mode into the second operating mode and the modified control of the lower main retarder in the second operating mode. Consequently, the cut and/or train formation yard also allows the automatic formation of trains whose length exceeds the useful length of the respective classification track, such that the car stack formed by the individual cuts extends into the region of the classification track retarder or even into the region ahead of the classification track retarder, i.e. between lower main retarder and classification track retarder. Since the required shunting quality is still ensured during this activity, it is possible to achieve a general increase in the performance of the hump yard and consequently an improvement in the efficiency of the humping operation.

It should be noted that the inventive method is usually performed specifically for the respective classification track, to the effect that a switch from the first operating mode into the second operating mode takes place specifically for the respective classification track. This means that cuts destined for a classification track which is completely full are handled in such a way that the lower main retarder is controlled according to the second operating mode, such that the cut reaches the identified target in or ahead of the classification track retarder at a speed which is lower than the second threshold value. However, those cuts destined for a different classification track, which is not yet completely full, continue to be handled according to the first operating mode, whereby the lower main retarder is controlled such that the cuts reach the respective classification track retarder at a speed which is lower than the first threshold value.

It should also be noted that the lower main retarder and the classification track retarder can be designed in each case as an individual brake element or as a plurality of brake elements, i.e. staggered brakes.

According to a particularly preferred development of the inventive method, a switch from the first operating mode into the second operating mode occurs if, with reference to a track occupancy forecast and/or a split list, a target for the cut is identified in or ahead of the classification track retarder of the classification track. This has the advantage that any overfilling of the respective classification track extending into a track region in and/or ahead of the classification track retarder can be detected at an early stage. This ensures prompt switching from the first operating mode into the second operating mode of the hump yard. In this case, the track occupancy forecast can in particular also give consideration to measurement information from sensors that are installed in the classification track or in the region of the classification track. Relevant sensors include e.g. track circuits for measuring free track length, wheel sensors for ascertaining the occupancy state of track sections or even radar sensors for distance measurement. The split list is usually provided by a terminal planning system and, in addition to data relating to the destination of the respective cut or the classification track in which the respective cut should be located, can for example also contain information concerning the type and length of the individual cars. Using a combination of the track occupancy forecast with information from the split list in particular, overfilling or possible overfilling of the classification track can therefore be detected with comparative precision and at an early stage.

According to a further particularly preferred embodiment, the inventive method is so configured that in the second operating mode the lower main retarder is controlled such that the cuts are braked to a lower release speed from the lower main retarder than in the first operating mode. The control of the lower main retarder in the second operating mode is essentially aimed at ensuring that the respective cut reaches the identified target in or ahead of the classification track retarder at a speed which is lower than the second threshold value. In comparison with the first operating mode, for cuts having comparable running characteristics, this however normally has the direct consequence that the release speed from the lower main retarder is lower in the second operating mode than in the first operating mode. Therefore the speed of the cuts in the region behind the lower main retarder is usually approximately 1.5 m/s to approximately 2 m/s in the second operating mode, while the speed of the cuts in this region will usually be at least approximately 3.5 m/s in the first operating mode.

The inventive method can advantageously also be so configured that in the second operating mode the lower main retarder is controlled such that further cuts destined for the classification track reach a target, which has been identified specifically for the respective further cut, at a speed that is lower than the second threshold value. This means that in the second operating mode a target is identified specifically for each cut and this target is taken into account when controlling the lower main retarder. In this case, the target i.e. destination point "moves" progressively in the direction of the hump, i.e. in the direction of the lower main retarder, as a result of the arrival of further cuts destined for the classification track. The respective target here can be ascertained, for example, by totaling the lengths of successive cuts on the basis of a track occupancy forecast for the classification track or the information that this classification track is occupied as far as the classification track retarder, such that the target is calculated specifically or individually for each further cut destined for the classification track concerned.

The inventive method is moreover preferably embodied such that, in the second operating mode, cut data which is specific to the respective cut is taken into account when controlling the lower main retarder. This is advantageous because specific cut data such as e.g. the weight or the rolling resistance of a cut, when taken into account in the second operating mode, allows particularly precise and reliable control of the lower main retarder and ultimately therefore the entire hump yard.

According to a further particularly preferred development, the inventive method is so configured that in the second operating mode the hump yard is controlled such that a cut following a cut for which a target has been identified in or ahead of the classification track retarder of the classification track maintains a minimal spatial and/or temporal distance relative to this cut. According to the foregoing explanations, in the second operating mode, cuts destined for the classification track concerned will generally have a lower speed in the region behind the lower main retarder than those cuts destined for a different classification track, which is not already completely full. In order reliably to prevent unacceptable impacts of consecutive cuts, e.g. in the form of so-called corner battering, it is therefore necessary in the second operating mode to control the hump yard such that a cut following a cut destined for a classification track that is completely full maintains a minimal spatial and/or temporal distance from this cut. All cuts can therefore be automatically braked by the lower main retarder in this way, while at the same time maintaining the required shunting quality. Until such time as the cars of a classification track which is filled beyond the classification track retarder reach the clearance marker contact of the last switching point, the humping operation is therefore not restricted in any way in respect of the usability of further classification tracks. After this time, however, individual classification tracks might no longer be available as the corresponding switching points are blocked by the cars of the train that has formed in the overfilled classification track. Irrespective of this, it should however be noted that in control engineering terms the inventive method allows the formation of trains which extend into the region of the release from the lower main retarder.

The inventive method can preferably also be configured such that the control of the hump yard includes control of the push-off speed of the cuts. For the purpose of maintaining a distance between a slow running cut destined for the overfilled classification track and a subsequent cut destined for a different classification track, for example, the optimal push-off speed for the cuts may be calculated by recalculating a humping simulation in this context. It may be necessary in this context to allow a corresponding slow cut to run through the hump yard alone, i.e. without concurrent running of further cuts. With regard to the next cut, the train can be halted at the hump if necessary and the humping operation only continued by automatically restarting the humping locomotive after a time delay. This is particularly relevant if the minimal speed at which the humping locomotive can run would otherwise not be reached. The control of the push-off speed can be provided by means of an automatic locomotive control, i.e. by acting directly on the drive control of the humping locomotive. Furthermore, it is also possible to transmit a desired push-off speed to the humping locomotive. In this case, the desired push-off speed can be taken into account by a control component of the humping locomotive or displayed on a display device of the humping locomotive if manual pushing-off is performed by an engine driver. In addition, control of the push-off speed can also be achieved by setting a humping signal to stop.

In respect of the control device, the object of the present invention is to specify a control device for a switching hump yard, which control device supports a method for operating switching hump yard, wherein said method allows even greater automation of the operation of the hump yard and ultimately therefore an improvement in the performance of the hump yard.

This object is inventively achieved by a control device for a switching hump yard, said control device being so designed that in a first operating mode a lower main retarder is controlled such that cuts in the form of rolling cars or car groups reach a classification track retarder of a classification track at a speed which is lower than a first threshold value, a switch from the first operating mode to a second operating mode occurs if for a cut a target is identified in or ahead of the classification track retarder of the classification track, and in the second operating mode the lower main retarder is controlled such that the cut reaches the identified target in or ahead of the classification track retarder at a speed which is lower than a second threshold value.

The advantages of the inventive control device correspond to those of the inventive method, and therefore reference is made to the corresponding explanations given above in this regard. The same applies to the preferred embodiments of the inventive control device as cited below in reference to the corresponding preferred developments of the inventive method, and therefore reference is again made to the corresponding explanations given above in this regard.

The inventive control device is preferably developed such that a switch from the first operating mode into the second operating mode occurs if, with reference to a track occupancy forecast and/or a split list, a target for the cut is identified in or ahead of the classification track retarder of the classification track.

According to a further particularly preferred embodiment, the inventive control device is so designed that in the second operating mode the lower main retarder is controlled such that the cuts are braked to a lower release speed from the lower main retarder than in the first operating mode.

The inventive control device can preferably also be so configured that in the second operating mode the lower main retarder is controlled such that further cuts destined for the classification track reach a target that has been identified specifically for the respective further cut at a speed which is lower than the second threshold value.

According to a further preferred embodiment, the inventive control device is configured such that, in the second operating mode, cut data which is specific to the respective cut is taken into account when controlling the lower main retarder.

The inventive control device can preferably also be developed such that, in the second operating mode, the hump yard is controlled such that a cut following a cut for which a target has been identified in or ahead of the classification track retarder of the classification track maintains a minimal spatial and/or temporal distance relative to this cut.

In this context, the inventive control device is advantageously further developed such that the control of the hump yard includes control of the push-off speed of the cuts. The invention further relates to a hump yard comprising a control device according to the invention and/or a control device as per one of the foregoing preferred developments of the control device according to the invention.

BRIEF DESCRIPTION OF THE DRAWING

The invention is explained in greater detail below with reference to exemplary embodiments. For this purpose, the FIGURE shows a schematic diagram of an exemplary embodiment of a hump yard.

DESCRIPTION OF THE INVENTION

A hump yard 10 can be seen in the FIGURE. In this case, the upper part of the FIGURE shows the track diagram of the hump yard 10 and the lower part of the FIGURE shows the profile or a longitudinal section of the hump yard 10.

According to the illustration in the FIGURE, the hump yard 10 as part of a switching system for rail traffic has a hump ramp 20 which is connected to an intermediate slope 30, a sorting zone 40 comprising switching points 80 to 86, and classification tracks 50 to 57. Retarders in the form of lower main retarders 60, 61 and classification track retarders 70 to 77 are also shown in the FIGURE.

In addition to the cited components of the hump yard 10, the FIGURE also includes an exemplary illustration of cuts 100 and 101, which have been pushed or humped over the hump by a humping locomotive 110 and then move along the hump yard 10 under the influence of gravity.

In the context of the further description, it is assumed that the classification track 50 is already so filled with cars forming a train that a target for the cut 100, which is likewise destined for the classification track 50, is identified in such a way that, owing to the existing occupancy state of the classification track 50, the cut 100 will come to a halt before it has completely passed through the classification track retarder 70. In other words, the classification track 50 therefore no longer has sufficient space for the cut 100 in the region behind (i.e. to the right of) the classification track retarder 70. As a consequence, the cut 100 can no longer be influenced in respect of its speed by the lower main retarder 60 in the manner that is usual in a first operating mode of the lower main retarder 60, whereby the lower main retarder 60 is controlled such that cuts reach the classification track retarder 70 at a speed which is lower than a first threshold value, this being e.g. 4 m/s. If the cut 100 were actually to be handled in the first operating mode, this would result in the cut 100 striking the last car standing in the classification track 50 at an impact speed which would normally be higher than the maximal permitted impact speed, this being typically approximately 1.5 m/s.

In order that the hump yard 10 and its lower main retarder 60 can be controlled automatically, efficiently and reliably even in this situation, provision is made for switching from the first operating mode into a second operating mode in the situation described. In this case, the second operating mode is characterized in that the lower main retarder 60 is controlled such that the cut 100 reaches the identified target in or ahead of the classification track retarder 70 at a speed which is lower than a second threshold value, i.e. at a speed of less than 1.5 m/s, for example. This means that automatic speed adjustment of the cut 100 by the lower main retarder 60 is advantageously still possible if the classification track 50 is already full as far as the classification track retarder 70 or beyond.

In the exemplary embodiment according to the FIGURE, it is specifically possible here to fill the classification track 50 beyond the classification track retarder 70 into the sorting zone 40. This can continue up to the clearance marker contact of the last switching point 82 in this case, without thereby restricting the accessibility of the other classification tracks, in particular of the classification track 51. If a corresponding restriction is permitted in respect of the accessibility of the further classification tracks 51 to 57, it is essentially possible in control engineering terms to use the entire region in the sorting zone 40 as far as the release from the lower main retarder 60, in addition to the actual classification track 50, for the formation of the train.

The switching from the first operating mode into the second operating mode is advantageously performed with reference to a track occupancy forecast and a split list, these being useful in the context of detecting the possible overfilling of the classification track 50 and identifying the target.

If the cut 101 is now also destined for the classification track 50, in the second operating mode, the lower main retarder 60 is controlled such that, in respect of the further cut 101, a target which is identified specifically for this cut is reached at a speed which is lower than the second threshold value. When identifying the target for the cut 101, it is preferably taken into account that the classification track 50 was already filled as far as the classification track retarder 70, and that the cut 100 was then also added to the end of the car stack standing in the classification track 50. As a result of further cuts arriving, the target therefore moves progressively in the direction of the hump, i.e. in the direction of the lower main retarder 60.

In the same way as the control of the lower main retarders 60, 61, the relevant totaling of the successive lengths of further cuts can be performed by a control device 200, which is linked to the lower main retarders 60, 61 via communication connections 210, 211 that may be wire-based or wireless. The control device 200 may be a central control device of the hump yard 10 in this case. Alternatively, it is also conceivable for the hump yard 10 to have a distributed control system and for the control device 200 within this distributed control system to assume e.g. the function of a control unit for lower main retarders. Regardless of this, the control device 200 comprises both hardware components in the form of e.g. processors and storage means, and software components in the form of e.g. program code.

In addition to taking the respective target into account, provision is advantageously made for taking specific cut data for the respective cut 100, 101 into account when controlling the lower main retarder 60 in the second operating mode. The cut data may be provided by a terminal planning system and/or measured or determined by sensors of the hump yard 10 in this case.

If the cut 101 is not destined for the classification track 50 but for the classification track 52, for example, the cut 101 can essentially be controlled by the lower main retarder 60 and the classification track retarder 72 in accordance with the first operating mode of the lower main retarder 60, such that it reaches the classification track retarder 72 of the classification track 52 at a speed which is lower than the first threshold value. This means that the switching between the first operating mode and the second operating mode essentially relates exclusively to the respective classification track and/or the respective classification track retarder.

Since without further measures the cut 101 would have a higher speed in the sorting zone 40 than the cut 100 in this case, it must nonetheless be ensured here that in the second operating mode the hump yard 10 is controlled such that the cut 101 following the cut 100, for which the target has been identified in or ahead of the classification track retarder 70 of the classification track 50, maintains a minimal spatial and/or temporal distance from said cut 100. This means that as a result of switching into the second operating mode for the classification track 50, a change in speed and/or brake control may also arise in relation to the cut 101 destined for the classification track 52. In particular, the corresponding control of the hump yard 10 may also include a control of the push-off speed of the cut 101 in this case. It is therefore possible, after switching from the first operating mode into the second operating mode, for a humping simulation to be recalculated and a modified optimal push-off speed calculated for the further cut 101. Depending on the respective conditions and the minimal rolling speed of the humping locomotive 110, it may be necessary in this context to initially halt the further cut 101 at the hump and then automatically restart the push-off operation after a time delay, when the cut 100 has passed the clearance marker of the switching point 81.

It should be noted that, in addition to the lower main retarders 60 and 61, further components which are not illustrated in the FIGURE for the sake of clarity will usually be linked to the control device 200 via technical communication means. This relates in particular to components for indicating the vacancy of track sections of the hump yard 10, sensors for ascertaining the occupancy level or occupancy state of the classification tracks 50 to 57, and sensors disposed in the region of the hump for measuring the length and the weight of the cuts.

According to the foregoing explanations, the exemplary embodiments of the inventive method and of the inventive control device as described with reference to the FIGURE have the particular advantage of allowing the classification tracks 50 to 57 to be filled automatically, efficiently and reliably, even as far as the classification track retarders 70 to 77 and beyond into the sorting zone 40. As a result, automatic train formation is also possible for trains whose length exceeds the useful length of the classification tracks 50 to 57 and which are normally restricted by the respective classification track retarders 70 to 77 in the direction of the hump, whereby the efficiency and performance of the hump yard 10 are ultimately improved.

The invention claimed is:

1. A method for operating a switching hump yard, the method comprising:

in a first operating mode, controlling a lower main retarder such that cuts in the form of rolling cars or car groups reach a classification track retarder of a classification track at a speed that is lower than a first threshold value;

if a target for a cut is identified in or ahead of the classification track retarder of the classification track, switching from the first operating mode into a second operating mode; and in the second operating mode, controlling the lower main retarder such that the cut reaches the identified target in or ahead of the classification track retarder at a speed that is lower than a second threshold value.

2. The method according to claim 1, which comprises switching from the first operating mode into the second operating mode if, with reference to a track occupancy forecast and/or a split list, a target for the cut is identified in or ahead of the classification track retarder of the classification track.

3. The method according to claim 1, which comprises controlling the lower main retarder in the second operating mode such that the cuts are braked to a lower release speed from the lower main retarder than in the first operating mode.

4. The method according to claim 1, which comprises controlling the lower main retarder in the second operating mode such that further cuts destined for the classification track reach a target which has been identified specifically for the respective further cut at a speed that is lower than the second threshold value.

5. The method according to claim 1, which comprises controlling the lower main retarder in the second operating mode with reference to specific cut data for the respective cut.

6. The method according to claim 1, which comprises controlling the hump yard in the second operating mode such that a cut following a cut for which a target has been identified in or ahead of the classification track retarder of the classification track maintains a minimal spatial and/or temporal distance from this cut.

7. The method according to claim 6, wherein controlling the hump yard includes controlling a push-off speed of the cuts.

8. A control device for a switching hump yard having a lower main retarder and classification tracks with classification track retarders, the control device being configured to:

control the lower main retarder in a first operating mode such that cuts in the form of rolling cars or car groups reach a classification track retarder of a classification track at a speed that is lower than a first threshold value;

to switch from the first operating mode into a second operating mode if a target for a given cut is identified in or ahead of the classification track retarder of the classification track; and control the lower main retarder in the second operating mode such that the given cut reaches the identified target in or ahead of the classification track retarder at a speed that is lower than a second threshold value.

9. The control device according to claim 8, wherein said control device is configured to switch from the first operating mode into the second operating mode if, with reference to a track occupancy forecast and/or a split list, a target for the cut is identified in or ahead of the classification track retarder of the classification track.

10. The control device according to claim 8, wherein the control device is configured to control the main retarder in the second operating mode such that the cuts are braked to a lower release speed from the lower main retarder than in the first operating mode.

11. The control device according to claim 8, wherein the control device is configured to control the lower main retarder in the second operating mode such that further cuts destined for the classification track reach a target which has been identified specifically for the respective further cut at a speed that is lower than the second threshold value.

12. The control device according to claim 8, wherein the control device is configured to control the main retarder in the second operating mode with reference to specific cut data for the respective cut.

13. The control device according to claim 8, wherein the control device is configured to control the hump yard in the second operating mode such that a cut following a given cut for which a target has been identified in or ahead of the classification track retarder of the classification track maintains a minimal spatial and/or temporal distance from the given cut.

14. The control device according to claim 13, wherein controlling the hump yard with the control device comprises controlling a push-off speed of the cuts.

15. A hump yard, comprising a control device according to claim 8.

* * * * *